US010605270B2

(12) United States Patent
Boutros-Mikhail et al.

(10) Patent No.: US 10,605,270 B2
(45) Date of Patent: Mar. 31, 2020

(54) SIDE-CHANNEL BLOWER FOR AN INTERNAL COMBUSTION ENGINE, COMPRISING A WIDE INTERRUPTING GAP

(71) Applicant: PIERBURG GMBH, Neuss (DE)

(72) Inventors: Matthias Boutros-Mikhail, Neuss (DE); Rainer Peters, Goch (DE)

(73) Assignee: PIERBURG GMBH, Neuss (DE)

( * ) Notice: Subject to any disclaimer, the term of this patent is extended or adjusted under 35 U.S.C. 154(b) by 303 days.

(21) Appl. No.: 15/541,715

(22) PCT Filed: Dec. 11, 2015

(86) PCT No.: PCT/EP2015/079414
§ 371 (c)(1),
(2) Date: Jul. 6, 2017

(87) PCT Pub. No.: WO2016/110371
PCT Pub. Date: Jul. 14, 2016

(65) Prior Publication Data

US 2018/0017084 A1 Jan. 18, 2018

(30) Foreign Application Priority Data

Jan. 9, 2015 (DE) ..... 10 2015 100 214

(51) Int. Cl.
*F04D 29/66* (2006.01)
*F04D 29/30* (2006.01)
(Continued)

(52) U.S. Cl.
CPC ..... *F04D 29/667* (2013.01); *F01M 13/02* (2013.01); *F04D 23/008* (2013.01);
(Continued)

(58) Field of Classification Search
CPC .... F04D 29/403; F04D 29/441; F04D 29/667; F04D 23/008; F04D 5/007; F05D 2250/52
See application file for complete search history.

(56) References Cited

U.S. PATENT DOCUMENTS 4,204,802 A 5/1980 Schönwald et al.
4,325,672 A 4/1982 Sixsmith et al.
(Continued)

FOREIGN PATENT DOCUMENTS

DE 691 01 249 T2 6/1994
DE 195 18 101 A1 12/1995
(Continued)

*Primary Examiner* — Igor Kershteyn
*Assistant Examiner* — Brian O Peters
(74) *Attorney, Agent, or Firm* — Norman B. Thot

(57) ABSTRACT

A side-channel blower for an internal combustion engine includes a flow housing, an impeller which rotates in the flow housing, a drive unit which drives the impeller, a housing wall with a radially delimiting housing wall, impeller blades arranged in a radially outer region of the impeller, a radial gap arranged between the impeller and the housing wall, an inlet, an outlet, and two flow channels. The housing wall radially surrounds the impeller. The impeller blades open in a radially outward direction. The two flow channels connect the inlet to the outlet and are fluidically connected to one another via intermediate spaces between the impeller blades. An interruption zone is arranged between the outlet and the inlet which interrupts the two flow channels in a peripheral direction. A radial interrupting gap is arranged between the impeller and the radially delimiting housing wall in the entire interruption zone.

7 Claims, 3 Drawing Sheets

(51) Int. Cl.

| | |
|---|---|
| ***F04D 29/26*** | (2006.01) |
| ***F04D 23/00*** | (2006.01) |
| ***F04D 29/16*** | (2006.01) |
| ***F04D 29/40*** | (2006.01) |
| ***F01M 13/02*** | (2006.01) |
| ***F04D 29/44*** | (2006.01) |
| *F04D 5/00* | (2006.01) |
| *F04D 29/42* | (2006.01) |

(52) U.S. Cl.

CPC ..... *F04D 29/161* (2013.01); *F04D 29/26* (2013.01); *F04D 29/30* (2013.01); *F04D 29/403* (2013.01); *F04D 29/441* (2013.01); *F01M 2013/026* (2013.01); *F04D 5/007* (2013.01); *F04D 29/4206* (2013.01); *F04D 29/663* (2013.01); *F05D 2250/53* (2013.01)

(56) References Cited

U.S. PATENT DOCUMENTS

| | | | |
|---|---|---|---|
| 5,281,083 | A | 1/1994 | Ito et al. |
| 5,299,908 | A | 4/1994 | Robbie |
| 5,302,081 | A | 4/1994 | Smith |
| 5,395,210 | A | 3/1995 | Yamazaki et al. |
| 5,499,502 | A | 3/1996 | Haniu et al. |
| 5,527,149 | A | 6/1996 | Moss et al. |
| 5,762,469 | A | 6/1998 | Yu |
| 6,422,808 | B1 | 7/2002 | Moss et al. |
| 6,986,643 | B2 | 1/2006 | Huang et al. |
| 7,033,137 | B2 | 4/2006 | Shufeldt |
| 2001/0028844 | A1 | 10/2001 | Narisako et al. |
| 2007/0001604 | A1 | 1/2007 | Lee |
| 2007/0077138 | A1 | 4/2007 | Tsuzuki et al. |
| 2007/0160456 | A1 | 7/2007 | Peterson et al. |
| 2013/0195607 | A1 | 8/2013 | Adhvaryu et al. |
| 2013/0209247 | A1 | 8/2013 | Herrmann et al. |
| 2013/0266434 | A1 | 10/2013 | Blackburn |

FOREIGN PATENT DOCUMENTS

| | | | |
|---|---|---|---|
| DE | 197 44 237 | A1 | 4/1998 |
| DE | 199 55 955 | A1 | 6/2001 |
| DE | 20 2004 019 506 | U1 | 4/2006 |
| DE | 10 2006 000 489 | A1 | 4/2007 |
| DE | 10 2010 046 870 | A1 | 3/2012 |
| EP | 1 672 222 | A2 | 6/2006 |
| EP | 1 672 222 | B1 | 9/2009 |
| JP | S54-47114 | A | 4/1979 |
| JP | 3003357 | B2 | 11/1999 |

SIDE-CHANNEL BLOWER FOR AN INTERNAL COMBUSTION ENGINE, COMPRISING A WIDE INTERRUPTING GAP

CROSS REFERENCE TO PRIOR APPLICATIONS

This application is a U.S. National Phase application under 35 U.S.C. § 371 of International Application No. PCT/EP2015/079414, filed on Dec. 11, 2015 and which claims benefit to German Patent Application No. 10 2015 100 214.0, filed on Jan. 9, 2015. The International Application was published in German on Jul. 14, 2016 as WO 2016/110371 A1 under PCT Article 21(2).

FIELD

The present invention relates to a side-channel blower for an internal combustion engine comprising a flow housing, an impeller that is rotatably arranged in the flow housing, impeller blades that are formed in the radially outer region of the impeller and are open in the radially outward direction, a radial gap between the impeller and a housing wall that radially surrounds the impeller, an inlet and an outlet, as well as two flow channels for a gas which connect the inlet to the outlet and which are formed axially opposite the impeller blades in the flow housing, the ducts being fluidically connected to one another via intermediate spaces between the impeller blades, a drive unit for driving the impeller, and an interruption zone which is located between the outlet and the inlet and in which the flow channels are interrupted in the peripheral direction.

BACKGROUND

Side-channel blowers or pumps have previously been described. In a vehicle, they serve, for example, to convey fuel, to blow secondary air into the exhaust system, or to convey hydrogen for PEM fuel cell systems. The drive is usually effected by an electric motor whose output shaft has the impeller arranged thereon. Side-channel blowers have previously been described in which only one flow channel is formed on an axial side of the impeller in a housing part, as well as side-channel blowers formed with a flow channel on either axial side of the impeller, in which case both flow channels are in fluid communication with each other. In such a side-channel blower, one of the flow channels is most often formed in a housing part which serves as a cover, while the other flow channel is formed in the housing part to which the drive unit is typically mounted, on the shaft of which the impeller is arranged to rotate therewith. The impeller is designed at its periphery so that it forms one or two circumferential vortex ducts together with the flow channel or the flow channels surrounding the impeller.

In side-channel blowers with two axially opposite vortex ducts, the impeller blades are divided axially across a radial section into two sections which are respectively assigned to the opposite flow channel. Pockets are formed between the impeller blades in which, when the impeller rotates, the fluid conveyed is accelerated by the impeller blades in the circumferential direction as well as in the radial direction so that a circulating vortex flow is generated in the flow channel. With impeller blades of a radially open design, an overflow from one flow channel to the other most often occurs via the gap between the radial end of the impeller and the radially opposite housing wall.

In order to obtain the best possible conveyance or pressure increase, different measures have been taken in conveying gases and liquids which are due to the different behavior of compressible and incompressible or slightly compressible media when they are conveyed.

The generation of noise should also be taken into account when conveying in side-channel blowers since acoustically disturbing pressure surges occur at the beginning of the interruption zone immediately after a medium has flowed over each impeller blade because compressed gas is still present in the pockets between the impeller blades, which gas has not been completely expelled via the outlet and is suddenly accelerated against the walls of the interruption zone when it reaches that zone. This causes significantly increased noise emissions.

Various outlet contours and designs of the interruption zone have previously been described for this reason. For example, DE 10 2010 946 870 A1 describes a side-channel blower in which recesses are formed behind the outlet in the radially delimiting housing wall which extend in the circumferential direction for several times the distance between the blades so that the interruption zone is formed in a stepped manner at the housing wall. The generation of noise may well be improved thereby, however, with such a design, the interruption zone extends over a circumferential angle of more than 60°, whereby the possible delivery rate and thus the efficiency of the blower is decreased since a shorter path is available for increasing pressure. The radial interrupting gap for preventing a short-circuit flow from the outlet directly to the inlet via the interruption zone is also merely about 0.3 mm. As a consequence, if such a blower is used in internal combustion engines at outside temperatures below the freezing point, condensates in the gap may freeze and block the impeller. Very accurate tolerances must further be observed during production and assembly so as to prevent contact between the impeller and the housing wall.

A side-channel pump is also described in DE 691 01 249 T2 whose interruption zone is significantly shortened. To still prevent an overflow and to minimize noise generation, various measures are taken, which, however, are based on the assumption that an overflow occurs in the region of the closed disc of the impeller. To avoid an overflowing of the interruption zone, the radial gap between the impeller and the housing wall is kept as small as possible, whereby problems in manufacture are again caused due to tolerances that must be observed, and a significant generation of noise occurs in the interruption zone as the gas leaves the impeller in the radial direction.

SUMMARY

An aspect of the present invention is to provide a side-channel blower with which the feed rate or the feed pressure of known side-channel blowers or comparable size is maintained, while the necessary tolerances can still be significantly increased in order to facilitate manufacture. An aspect of the present invention is to thereby prevent the formation of ice bridges in the blower and to make the blower less susceptible to the accumulation of dirt. An aspect of the present invention is also to prevent an overflowing of the interruption zone and if possible to reduce the generation of noise.

In an embodiment, the present invention provides a side-channel blower for an internal combustion engine which includes a flow housing, an impeller configured to rotate in the flow housing, a drive unit configured to drive the impeller, a housing wall comprising a radially delimiting housing wall, impeller blades arranged in a radially outer region of the impeller, a radial gap arranged between the impeller and the housing wall, an inlet, an outlet, and two flow channels for a gas. The housing wall is configured to radially surround the impeller. The impeller blades are configured to open in a radially outward direction. A respective one of the two flow channels is respectively formed axially opposite to the impeller blades in the flow housing. The two flow channels are configured to connect the inlet to the outlet and to be fluidically connected to one another via intermediate spaces between the impeller blades. An interruption zone is arranged between the outlet and the inlet. The interruption zone is configured to interrupt the two flow channels in a peripheral direction. A radial interrupting gap is arranged between the impeller and the radially delimiting housing wall in the entire interruption zone. The radial interrupting gap is 0.005 to 0.03 times a diameter of the impeller.

BRIEF DESCRIPTION OF THE DRAWINGS

The present invention is described in greater detail below on the basis of embodiments and of the drawings in which.

DETAILED DESCRIPTION

Figure 1:
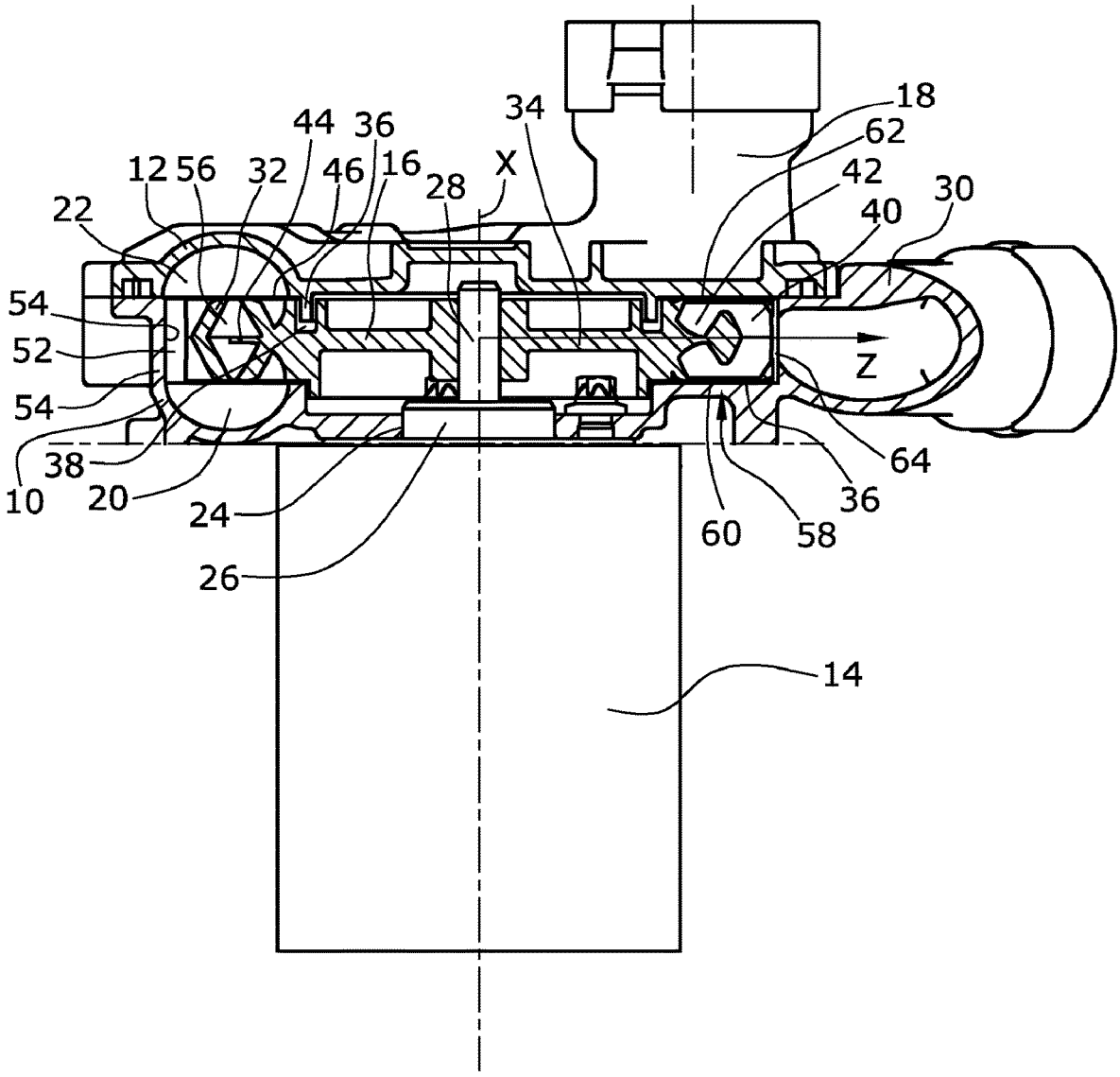
FIG. 1 shows a sectional side view of a side-channel blower according to the present invention.
Figure 2:
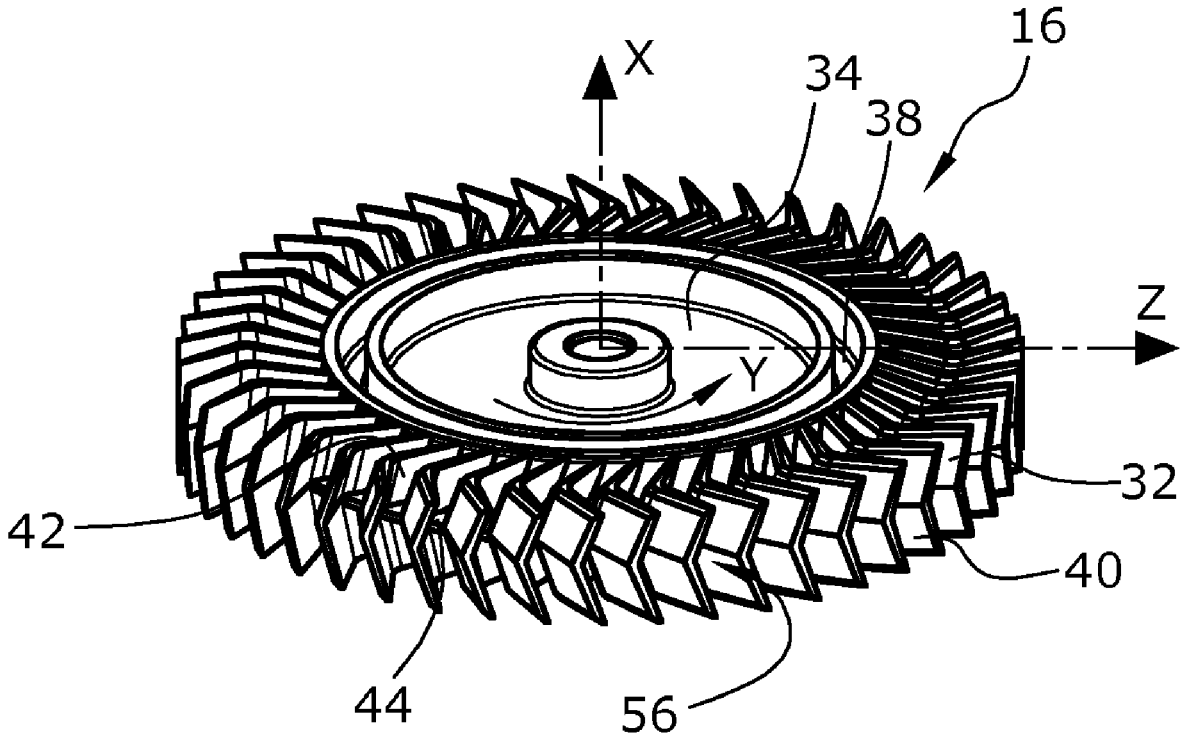
FIG. 2 shows a perspective view of a detail of the impeller of the side-channel blower in FIG. 1.
Figure 3:
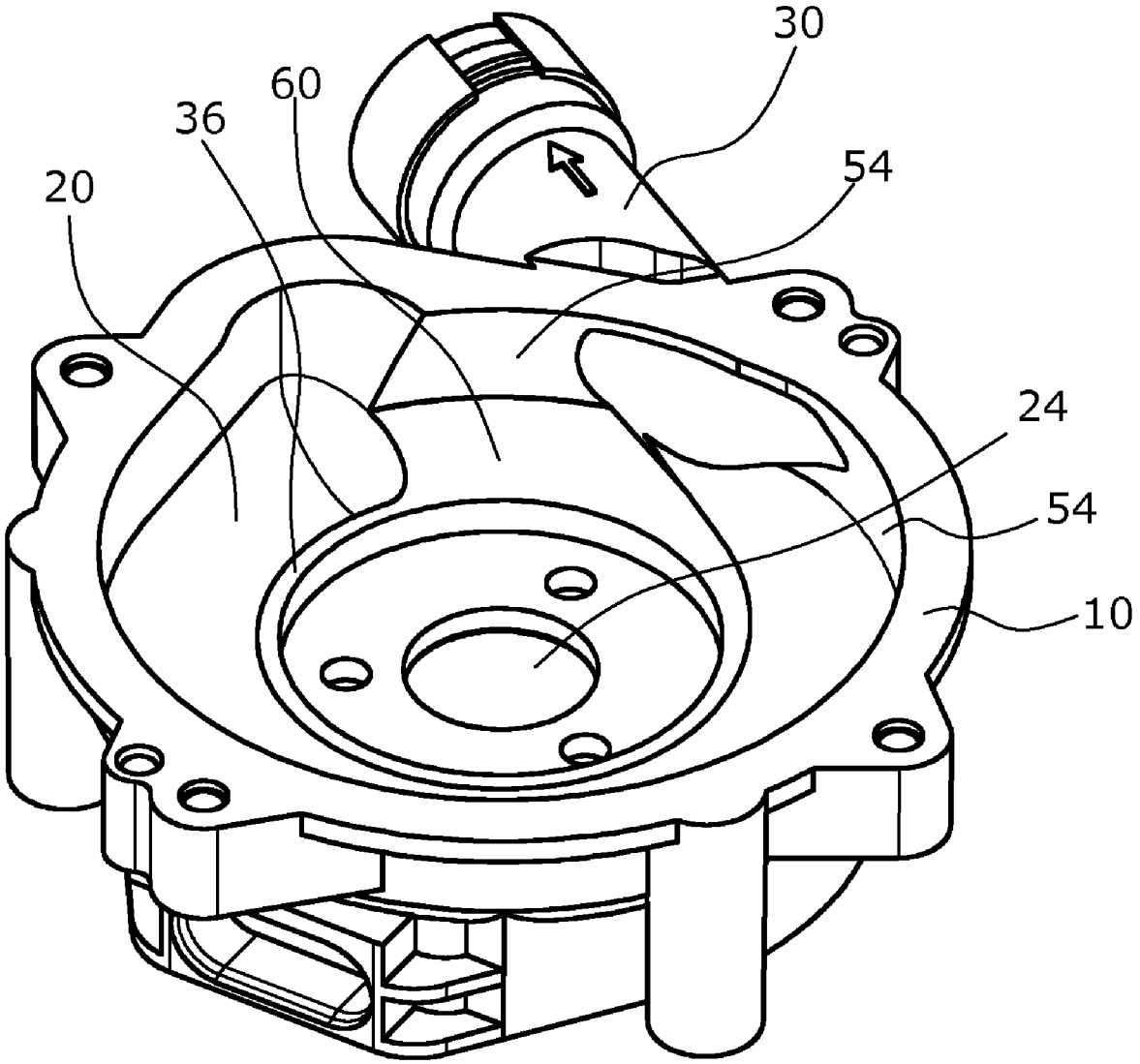
FIG. 3 shows a perspective view of a bearing housing of the side-channel blower in FIG. 1 according to the present invention.

Contrary to expectations, such an optimization in conveying compressible media is achieved with a side-channel blower in which a radial interruption gap between the impeller and the radially delimiting housing wall in the entire interruption zone is 0.005 to 0.03 times the impeller diameter. This corresponds to an increase of the gap by a factor of two to ten as compared to known designs, whereby the susceptibility to the formation of ice or to contaminating substances in the gas conveyed is reduced significantly and manufacture is clearly simplified due to the low tolerances which must be observed. At the same time, no restriction of the delivery rate is expected since, given this distance, the gap acts as a dynamic gas seal with the pressure in the gap being sufficiently increased.

In an embodiment of the present invention, the interruption zone can, for example, merely extend over an angle between 20° and 40° of the total circumference of the flow housing. Due to the extension of the flow channels resulting therefrom, no restriction occurs with respect to the delivery rate and the efficiency. The area available for possible accretions and ice formation is also reduced.

In an embodiment of the present invention, the impeller blades can, for example, be formed in a V-shape, as seen in cross section, so that, with respect to the rotary axis, the impeller blades are inclined in the direction of rotation and extend in the direction of their opposite flow channel. At the same time, the impeller is formed to be open both in the axial and in the radial direction in the radially outer region so that gas is gathered in the axial center of the blade and is accelerated, which has proven beneficial to the formation of the spiral flow, a constant exchange being possible between the two flow channels. A very high pressure is generated in the radial gap with this impeller design which prevents a short-circuit flow from the inlet to the outlet, as with the use of a dynamic gas seal. A leakage with the resulting reduction in delivery rate is thereby reliably avoided.

An optimal inclination of the blades with respect to the rotary axis is 5° to 20° in the direction of rotation of the impeller. A particularly high efficiency is obtained with such an angle since an optimal pressure is achieved on the inner side of the blades.

In an embodiment of the present invention, in their radially outer end region, the impeller blades can, for example, be formed so that they are inclined in the direction of rotation of the impeller with respect to the intermediate region of the impeller blades adjoining the end region on the radially inner side. An additional acceleration is thereby generated as the medium is moved radially outward, whereby the pressure generated in the gap is further increased, thereby improving the sealing effect.

In an embodiment of the present invention, the radial end region of the impeller blades can, for example, be inclined by 5° to 20° in the direction of rotation with respect to the radial direction, and the adjacent intermediate region of the impeller blades can, for example, be inclined by 5° to 20° against the direction of rotation with respect to the radial direction. An optimized feed pressure of the blower with the resulting sealing effect and an improvement of the delivery rate are obtained with these pitch angles.

In this embodiment of the impeller, in connection with the rather wide gap in the interruption zone, it has additionally proven beneficial if the outlet extends tangentially from the flow channels in the flow housing and has a circular cross section that substantially corresponds to the cross section of the flow channels. This embodiment reduces the noise emissions generated, in particular by allowing a distribution of the flow in the gap due to the wide gap.

In an embodiment of the present invention, a partition wall can, for example, be formed at the height of the connection between the two legs of the V-shaped impeller blades, which partition wall extends radially over the intermediate region of the impeller blades that adjoins the end region. Pressure losses are thereby prevented that are caused by the two gas flows from the two flow channels axially converging at the radially inner edge of the impeller blades or the flow channels, respectively, and improves the formation of the two vortex flows, thereby again increasing the pressure in the gap and thus improving the sealing effect.

A side-channel blower is thus provided in which, compared to previously described side-channel blowers for compressible media, a high pressure is generated in the gap, while the feed rate is maintained, whereby a counter pressure against a short-circuit flow is generated in the gap, as with the use of a gas seal. The impeller and the housing can be manufactured with larger tolerances, thereby reducing manufacturing costs. The susceptibility to accretions, foreign matter, and ice bridge formation is clearly reduced when compared to known designs.

An embodiment of a side-channel blower according to the present invention is illustrated in the drawings and will be described below.

The side-channel blower illustrated in FIG. 1 has a bipartite flow housing formed by a bearing housing 10 and a housing cover 12 fastened thereto, for example, by screws. An impeller 16 is supported in the bearing housing 10, the impeller 16 being rotatable by a drive unit 14. The compressible medium conveyed reaches the interior of the side-channel blower via an axial inlet 18 formed in the housing cover 12.

The medium then flows from the inlet 18 into two substantially annular flow channels 20, 22, of which the first flow channel 20 is formed in the bearing housing 10 in the central opening 24 of which a bearing 26 of a drive shaft 28 of the drive unit 14 is also arranged, the impeller 16 being fastened on the drive shaft 28, and the second flow channel 22 being formed in the housing cover 12. The air leaves via a tangential outlet 30 formed in the bearing housing 10.

The impeller 16 is arranged between the housing cover 12 and the bearing housing 10 and has impeller blades 32 along its circumference which extend from a disc-shaped central part 34 that is fastened on a drive shaft 28 forming an rotary axis X of the impeller 16, the two flow channels 20, 22 being formed axially opposite the blades. A sealing from the two flow channels 20, 22 to the interior of the impeller 16 is obtained by circumferential corresponding webs 36 and grooves 38 in the housing parts 10, 12 and the disc-shaped central part 34 of the impeller 16.

The impeller blades 32 of the impeller 16 have a radially outer end region 40, as well as a radially adjoining intermediate region 42 arranged between the disc-shaped central part 34 and the radially outer end region 40. In this intermediate region 42, the impeller blades 32 are divided by a radially extending partition wall 44 into a first row axially opposite the first flow channel 20 and a second row axially opposite the second flow channel 22 so that two vortex ducts are formed that are each formed by a respective one of the two flow channels 20, 22 and the part of the impeller blades 32 facing the respective one of the two flow channels 20, 22. No separation exists in the radially outer end region 40 so that an exchange of medium between the two flow channels 20, 22 is possible in this region.

The two flow channels 20, 22 arranged in the bearing housing 10 and in the housing cover 12 have a substantially constant width and extend over an angle of about 330° in the bearing housing 10 and in the housing cover 12.

The outer diameter of the two flow channels 20, 22 is slightly larger than the outer diameter of the impeller 16 which is, for example, about 85 mm, so that a fluidic connection between the two flow channels 20, 22 also exists outside the outer circumference of the impeller 16. A radial gap 52 of 3 to 6 mm in dimension is thus formed between the radially delimiting housing wall 54 and the radial end of the impeller 16, where a correspondingly larger impeller 16 requires a correspondingly larger radial gap 52 as well. Pockets 56, which are open radially outwards, are thus formed between the impeller blades 32, in which pockets 56 the medium is accelerated so that the pressure of the medium is increased over the length of the two flow channels 20, 22.

In the shown embodiment, the impeller blades 32 are inclined, with respect to the radial direction Z, in the intermediate region 42 by an angle of about 10° against the direction of rotation of the impeller 16. In the adjoining radially outer end region 40, the impeller blades 32 are inclined by an angle of 20° in the direction of rotation, compared to the intermediate region 42, or they extend in this radially outer end region 40 by an angle of 10° in the direction of rotation with respect to the radial direction Z. This causes an additional acceleration of the medium during the rotation of the impeller 16 at a speed of about 12,000 to 24,000 rpm.

The impeller blades 32 are also V-shaped over their entire substantially radial extension, when seen in cross section, i.e., when cut perpendicularly to the circumferential direction or the direction of rotation Y, so that each leg of each impeller blade 32 is assigned to its opposite flow channel 20, 22 and the radially extending partition wall 44 is arranged between the legs in the intermediate region 42. Compared to a vector extending in parallel with the rotary axis X, each leg is inclined by about 15° in the direction of rotation of the impeller 16 and is formed to extend towards the opposite flow channel 20, 22. In other words: the axial ends of the two legs are each leading with respect to the point at which the two legs join each other.

When the impeller 16 is rotated by the drive unit 14, the gas from the two flow channels 20, 22 enters the pockets 56 in the radially inner intermediate region 42. A maximum accumulation of the gas occurs in the central region of each of the impeller blades 32 due to the rotation and the shape of the impeller blades 32. This accumulated gas is then accelerated outwards via the axially central region, the inclination of the radially outer end region 40 generating an additional acceleration exceeding that caused by the normal rotational speed. With this pressure, the gas is accelerated towards the radially delimiting housing wall 54, which is correspondingly arranged at a distance of 3 to 6 mm from the outer circumference of the impeller 16, so that a larger space is available for deflection towards the two flow channels 20, 22. The two flow channels 20, 22 are then flowed through again from radially outside to the inside. The gas thereafter again enters the pockets 56 to be accelerated once more. A helical movement is thus obtained along each of the two flow channels 20, 22 from the inlet 18 to the outlet 30. This leads to a good delivery rate of the blower.

The outlet 30 has a circular cross section, whereby the cross section available for outflow from each of the pockets 56 gradually decreases during a rotation of the impeller 16.

As the impeller 16 rotates, the impeller blades 32 are thereafter moved over an interruption zone 58 extending over an angle of about 30° between the inlet 18 and the outlet 30. The zone interrupts the two flow channels 20, 22 and prevents a short-circuit flow from the inlet 18 to the outlet 30 against the direction of rotation of the impeller 16. For this purpose, wall surfaces 60, 62 are formed at the height of the impeller blades 32 in parallel with the impeller 16 between the inlet 18 and the outlet 30 in the bearing housing 10 and the housing cover 12, which wall surfaces 60, 62 interrupt the two flow channels 20, 22, wherein a gap as small as possible exists between these wall surfaces 60, 62 and the axially opposite impeller blades 32 of the impeller 16.

According to the present invention, a radial interrupting gap 64 is formed between the radially delimiting housing wall 54 and the outer circumference of the impeller 16, the width of the radial interrupting gap being about 0.5 to 2.5 mm. This radial interrupting gap 64 is thus clearly larger than the conventional gaps of about 0.3 mm in this region. It is also possible to make this radial interrupting gap 64 correspondingly larger when the impeller 16 is designed to have a larger size. When the impeller blades 32 pass over the interruption zone 58, a part of the residual gas can at first flow from the pockets 56 to the outlet 30 via the interruption zone 58, whereby the generation of noise is reduced compared to designs with narrower gaps. The residual gas is conveyed centrally toward the radially delimiting housing wall 54 at a high velocity due to the high acceleration caused by the shape of the impeller blades 32. A pressure is thereby caused in the radial interrupting gap 64 which has a sealing effect with respect to the inlet 18 so that the radial interrupting gap 64 acts like a dynamic gas seal. A short-circuit flow from the inlet 18 directly to the outlet 30 is largely suppressed by this pressure.

A side-channel blower for compressible media is thus provided which can be manufactured with clearly less strict tolerances since the gap in the region of the interruption can be significantly larger, while a sufficient sealing from the inlet towards the outlet 30 still exists. The manufacturing costs and the assembly costs are reduced correspondingly. Due to the greater distance between the rotating and the stationary parts and the larger angular range of the interruption, the susceptibility to the formation of ice and to the accumulation of dirt is also reduced. High differential pressures are generated due to the path length of the flow channels, by which the effect of a dynamic gas seal is obtained in the interrupting gap without having to expect limitations with respect to the delivery rates.

It should be clear that various modifications can be made to the embodiment of the side-channel blower described without leaving the protective scope of the main claim. For example, the drive, the inlet and the outlet, the interruption and outlet contours or the fastening and sealing structures can be modified. Further modifications are also conceivable. Reference should also be had to the appended claims.

What is claimed is:

1. A side-channel blower for an internal combustion engine, the side-channel blower comprising:

a flow housing;

an impeller configured to rotate in the flow housing;

a drive unit configured to drive the impeller;

a housing wall comprising a radially delimiting housing wall, the housing wall being configured to radially surround the impeller;

impeller blades arranged in a radially outer region of the impeller, the impeller blades being configured to open in a radially outward direction;

a radial gap arranged between the impeller and the housing wall;

an inlet;

an outlet;

two flow channels for a gas, a respective one of the two flow channels being respectively formed axially opposite to the impeller blades in the flow housing, the two flow channels being configured to connect the inlet to the outlet and to be fluidically connected to one another via intermediate spaces between the impeller blades;

an interruption zone arranged between the outlet and the inlet, the interruption zone being configured to interrupt the two flow channels in a peripheral direction; and a radial interrupting gap arranged between the impeller and the radially delimiting housing wall in the entire interruption zone, the radial interrupting gap being 0.005 to 0.03times a diameter of the impeller, wherein, the interruption zone is further configured to extend over an angle which is between 20° and 40° of a total circumference of the flow housing.

2. The side-channel blower as recited in claim 1, wherein, the impeller comprises a rotary axis, and the impeller blades are further configured, as seen from a cross section of a plane lying perpendicular to the rotary axis, to comprise a V-shape and to be inclined in a direction of rotation of the impeller, and, as seen from a cross section of a plane on which the rotary axis lies, to comprise a first leg and a second leg which are joined together via a connection, respective axial ends of the first leg and the second leg being configured to extend in a direction of the respective opposite of the two flow channels.

3. The side-channel blower as recited in claim 2, wherein the impeller blades are inclined in the direction of rotation of the impeller by 5° to 20°.

4. The side-channel blower as recited in claim 2, wherein, the impeller blades each comprise a radially outer end region and an intermediate region which adjoins the radially outer end region on a radially inner side of the radially outer end region, and the radially outer end region of each of the impeller blades is formed to be inclined in the direction of rotation of the impeller with respect to the intermediate region.

5. The side-channel blower as recited in claim 4, further comprising:

partition walls arranged at a height of the connection between the first leg and the second leg, the partition wall being configured to extend radially over the intermediate region of the impeller blades that adjoins the radially outer end region.

6. The side-channel blower as recited in claim 4, wherein, the radially outer end region of the impeller blades is inclined by 5° to 20° in the direction of rotation of the impeller with respect to a radial direction, and the intermediate region of the impeller blades is inclined by 5° to 20° against the direction of rotation of the impeller with respect to the radial direction.

7. The side-channel blower as recited in claim 1, wherein, the two flow channels comprise a cross section, and the outlet is configured to extend tangentially from each of the two flow channels in the flow housing and to comprise a circular cross section which substantially corresponds to the cross section of the two flow channels.

* * * * *